United States Patent [19]

Weidmo et al.

[11] Patent Number: 4,817,339

[45] Date of Patent: Apr. 4, 1989

[54] PROCESS AND DEVICE FOR GRINDING ELONGATED OBJECTS

[76] Inventors: Thomas Weidmo, Slagavägen 9, S-198 00 Bålsta; Lars G. E. Edlund, Mörbylund 17, S-182 30 Danderyd; Knut S. R. Gullstrand, Kevingeringen 83, S-182 33 Danderyd; Carl H. J. Malmgren, Styrmansgatan 50, S-114 60 Stockholm; Erik B. Eskilsson, Mörbyleden 20, S 182 12 Danderyd, all of Sweden

[21] Appl. No.: 924,364

[22] Filed: Oct. 29, 1986

[30] Foreign Application Priority Data

Nov. 7, 1985 [SE] Sweden ..... 8505266

[51] Int. Cl.[4] ..... B24B 9/04; B24B 17/00

[52] U.S. Cl. ..... 51/165.71; 51/228; 51/273

[58] Field of Search ..... 51/228, 273, 165.71

[56] References Cited

U.S. PATENT DOCUMENTS

| | | | |
|---|---|---|---|
| 2,814,171 | 11/1957 | Bogart | 51/273 |
| 3,735,533 | 5/1973 | Salberg | 51/228 |
| 3,827,185 | 8/1974 | Smith | 51/228 |
| 4,004,378 | 1/1977 | Maxey | 51/273 |
| 4,235,050 | 11/1980 | Hannaford | 51/228 |
| 4,528,780 | 7/1985 | Halberschmidt | 51/165.8 |

FOREIGN PATENT DOCUMENTS

| | | |
|---|---|---|
| 315527 | 12/1967 | Sweden . |
| 84043967 | 3/1984 | Sweden . |

*Primary Examiner*—Robert P. Olszewski

*Attorney, Agent, or Firm*—Foley & Lardner, Schwartz, Jeffery, Schwaab, Mack, Blumenthal & Evans

[57] ABSTRACT

A process and a device for grinding, especially edge grinding, of elongated objects (15), the device consisting of a basic frame (1) which supports a carriage (13) horizontally displaceable by means of a first pulse motor (23) and a scanning member or a grinding wheel (18) vertically displaceable by means of a second pulse motor (25) and where the carriage (13) is equipped with members for clamping of the object (15) to be ground, and where the carriage (13) is directly connected to members (27) for observation when the scanning member in a vertical movement comes into contact with the object (15) to be ground. The process comprises as a first step scanning of an existent profile of the object (15) to be ground, whereunder alternately (a) the carriage (13) is displaced over a little distance and (b) the scanning member is diplaced to contact with the object (15) to be ground, which values are recorded and treated in a connected computer (7) to be utilized thereafter in a second step for control of the grinding wheel (18) which thereunder exactly imitates the scanned and computed values.

13 Claims, 2 Drawing Sheets

PROCESS AND DEVICE FOR GRINDING ELONGATED OBJECTS

BACKGROUND OF THE INVENTION

1. Field of the Invention

Figure 1:
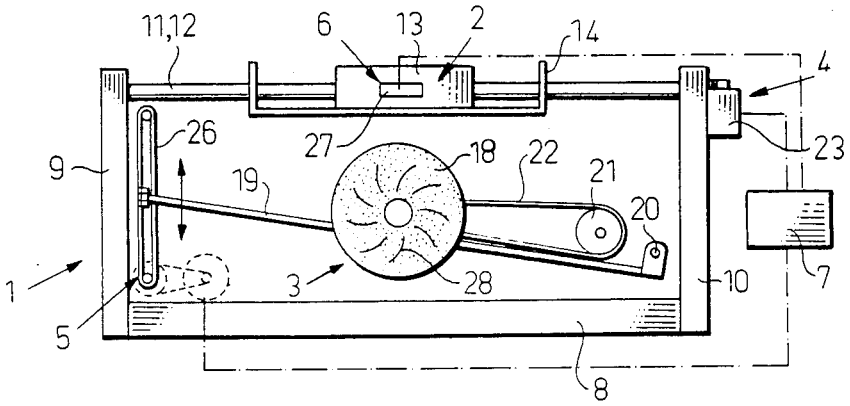

This invention relates generally to a process and a device for grinding elongated objects, and more particularly the invention relates to such a method and device where the grinding is effected with great exactitude in a manner programmed by a computer, especially the grinding of objects where the surface to be ground has a specific profile or a non-even or irregular extension.

2. Description of the Related Art

Elongated objects are in this connection understood to comprise various different objects which under manufacture and/or reconditioning or for maintenance need grinding, especially along a longish edge of the object. As examples may be mentioned the grinding of knives, scissors, surgical and other instruments.

A specific sphere, where the process and the device according to the invention are highly suited, is the grinding of skates, and the invention will be described to some extent in the following in connection with the grinding of skates and similar objects.

Different types of skates have different profiles in both the transversal and the longitudinal directions, and the grinding of skates implies a complicated working moment. Some types of skates shall be surface-ground, other ones shall be hollow-ground; some skates have a longitudinally highly curved sliding surface, other ones have a merely slightly curved surface; some skates shall have a plane so-called sliding surface somewhere at or near the middle portion of the skate rail and extending from this at least relatively plane sliding surface a more curved longitudinal profile.

Previously, the grinding of skates has usually been made manually against a rotating wheel or an endless belt, sometimes with the aid of some kind of chucking appliance. Such manual grinding has implied a complicated and tedious work which required high craftsmanship. In spite of great cleverness the grinding was carried out more or less at random.

In order to attain to make possible to perform the grinding operation with greater accuracy than has been possible with manual grinding, it has been regarded as necessary that the object to be ground, such as, for example skates, are clamped in a machine and that the skate bar as well as the grinding wheel or the grinding belts are displaced in a guided and controlled manner in relation to one another.

A machine for grinding skates is known from the Swedish Pat. No. 315,527, wherein the object to be ground, in this case the skate, is clamped in a machine frame in such a manner that the skate can be displaced in all directions in planes parallel to a grinding wheel.

A similar machine is known also from the published Swedish patent application No. 84 04396-7, in which device a skate is arranged to be clamped in a machine frame whereupon a grinding wheel capable of becoming displaced in parallel to the machine frame is moved forwards and backwards while the grinding wheel simultaneously is lifted and lowered in relation to the desired profile of the object for the grinding operation.

It should be possible by utilizing modern data systems engineering to feed the computer with information about an ideal profile for the grinding operation, for instance by continuously with a scanner following the profile of the clamped object to be ground and simultaneously in the computer recording the vertical and horizontal movements of the scanner and thereupon utilizing the scanned and recorded curve by moving the grinding wheel forwards and backwards over the object to be ground in exact conformity with the recorded curve. One idea has been to use the grinding wheel proper for scanning the existing longitudinal profile of the object to be ground.

For the scanning of the longitudinal profile of the object to be ground, the apparatus requires two motors operating independently from each other, viz. one motor for horizontal movements, hereinafter called X-motor, and one motor for vertical movements, hereinafter called Y-motor. In continuous scanning of the profile, the X-motor and the Y-motor work simultaneously, and the values of the displacements of the motors are recorded and processed in the computer.

It has, however, become apparent that such a device may be inexpedient, especially in those cases where great exactness is desired. In the grinding of many objects, such as skates, for example, a sliping exactitude of some hundreds or possibly some millesimals of a millimeter is desired. By having, during the continuous scanning, at times both motors at work simultaneously and at times only the one motor working and by having some times one of the motors stopped and started again, there are, unavoidably, vibrations provoked which result in unexact values which are reproduced in the grinding object in the subsequent course of the grinding operation.

A grinding wheel may in many cases be slightly noncircular, and in the case that the grinding wheel itself is used for the scanning of the longitudinal profile of the object to be ground by being caused to roll over the object, inexact values are also fed into the computer, which are reproduced also and perhaps also are superposed occurring vibrations and result in an inexact grinding.

Therefore, the background of the invention has been constituted by the problem of procuring a process and device for scanning the longitudinal profile of an object to be ground with greatest possible exactness and without—as far as possible—disturbing pulses recording the scanned values in a computer computing the best grinding profile on the basis of the recorded values, and grinding the object with greatest possible exactness in a predetermined and controlled manner for obtaining desired grinding geometry in consideration of the output values from the computer for the best possible grinding profile.

SUMMARY OF THE INVENTION

In a preferred process according to the invention the scanning of the existing grinding profile of the object—or possibly according to an ideal pattern—is effected intermittently by firstly moving an object to be ground over a very short distance in the X-direction, whereupon the X-motor is stopped and the value X recorded. Thereafter the Y-motor is actuated to perform a vertically ascending travel, and a point of record is obtained when a scanning member strikes against the object to be ground and the movement of the scanning member in the Y-direction is stopped thereby. The Y-value is recorded and the scanning member is lowered for a little distance so that it is completely clear from the object to be ground. In some cases it may be suitable to cause the scanning member to perform two or more scanning movements in the Y-direction and to record the Y-value not earlier than when two or more values exactly coincide with one another.

The X- and Y-motors may be pulse motors, the activity pulses of which have a length of only some hundreds or a few millesimals of a millimeter. In order to obtain the greatest possible exactness, a reduction gear may be interposed between the pulse motors and the scanner.

According to a particularly preferred embodiment of the process according to the invention, the object to be ground is set up on a forwards and backwards movable carriage which is capable of becoming moved with great accuracy past the scanner, the X-motor being caused to act on the carriage with the object to be ground, while the Y-motor is caused to act on the scanner which thus moves solely up and down in the Y-direction in each X-position just then taken by the carriage.

In connection with this stepwise scanning of the grinding profile and recording of the values the recorded values are processed in the computer according to a predetermined programme, whereupon the grinding operation proper can be commenced. The grinding operation may be carried out by continuous displacement of a rapidly rotating grinding wheel or grinding belt or belts, but in order to eliminate vibrations or other instability factors as far as possible, one causes in the same manner as possibly has been done in the scanning operation, the object to be ground to become displaced in the X-direction past the grinding wheel or the grinding belt, whereas the grinding wheel or band is displaced solely in the Y-direction.

BRIEF DESCRIPTION OF THE PREFERRED EMBODIMENTS

More particular characteristic features and advantages of the invention will become apparent from the following detailed description, in which reference will be made to the attached drawings. It is, however, understood that the following description and the embodiment shown in the drawings constitute an illustrative example only, and that many different modifications may within the scope of the concluding claims.

Figure 2:
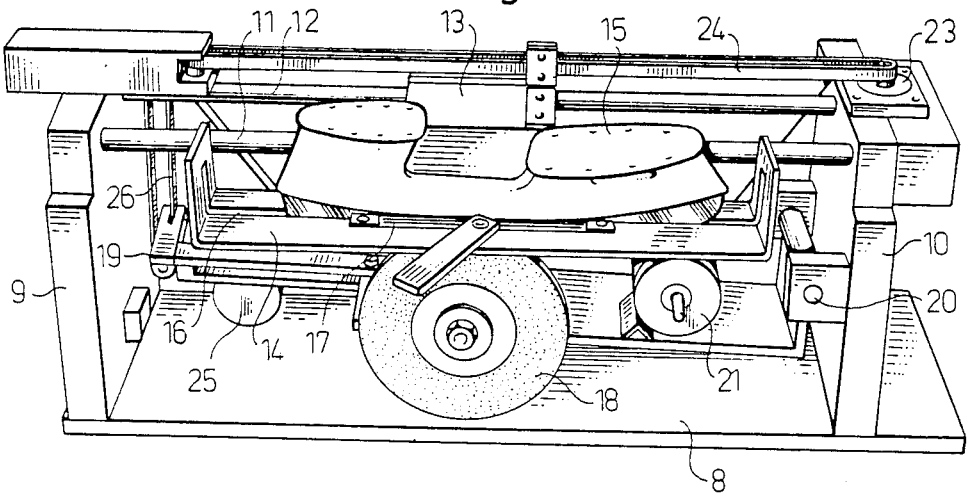
Figure 5:
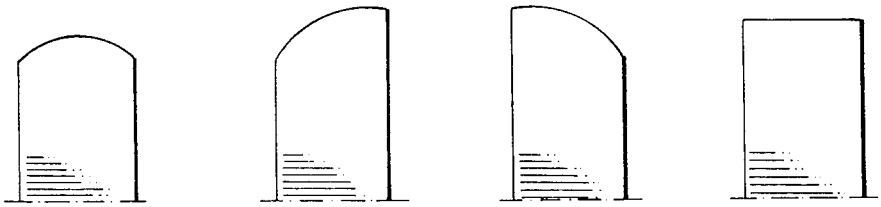
Figure 3:
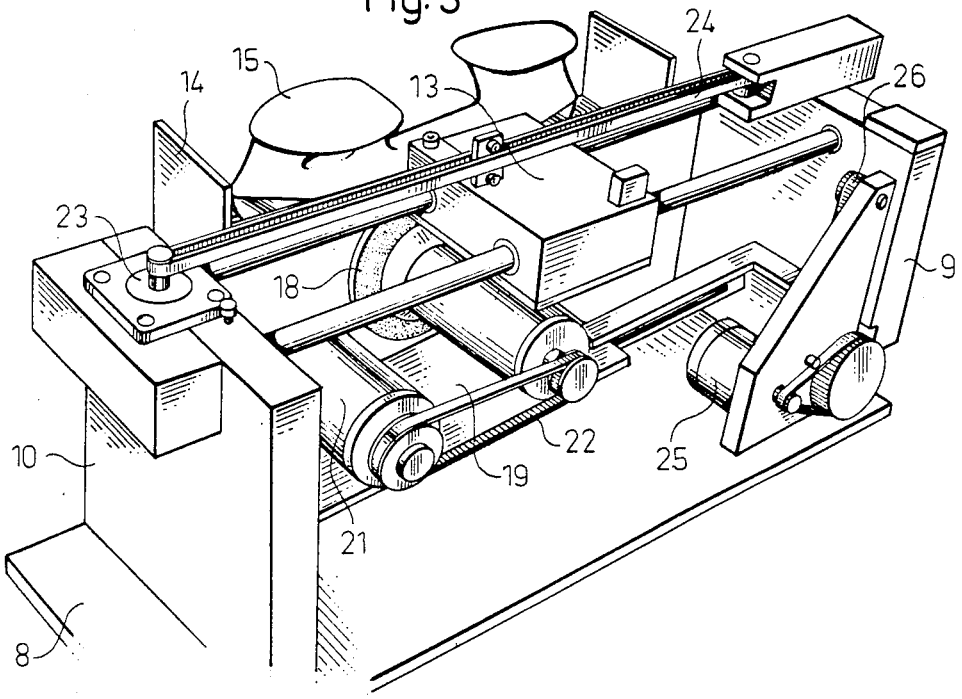
Figure 4:
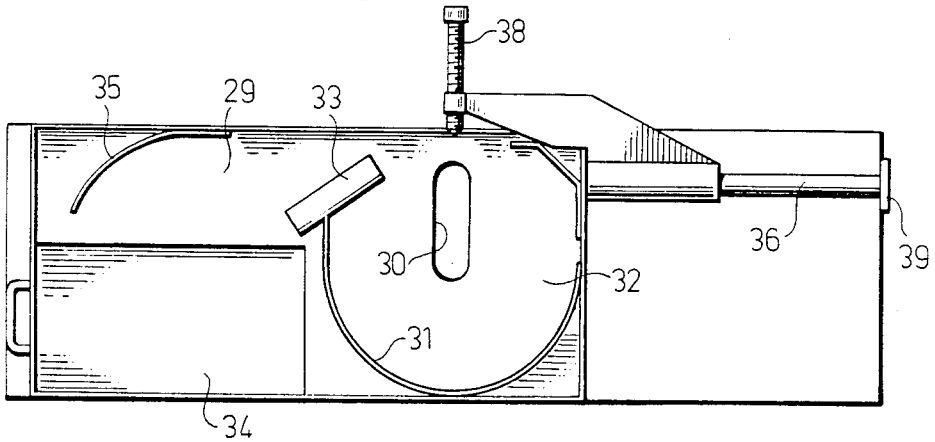

On the there are shown in:

FIG. 1 an explanatory sketch of a device for carrying out the process according to the invention;

FIG. 2 a perspective front view of a grinding apparatus according to invention with some details removed for the sake of clearness;

FIG. 3 a perspective rear view of the apparatus of FIG. 2;

FIG. 4 a detail in the grinding apparatus of FIGS. 2 and 3 for adjustment of the grinding wheel and for removal by blowing off grinding dust, and FIG. 5 examples of some various types of grinding wheel profiles which can be produced with the adjusting equipment in the grinding machine.

The device shown in the figures consists generally of a basic frame 1 which in a displaceable manner supports a member 2 for displacement of the object to be ground, a grinding wheel 3, a member 4 for displacing the object to be ground forwards and backwards, a member 5 for raising and lowering the grinding wheel, a sensor member 6 for marking of the profile height in the object to be ground and a computer 7 for coordination of the various functions of the grinding apparatus.

The basic frame 1 may be shaped in any suitable way so as to constitute a stable support for the various parts in the apparatus, add it is shown in the drawings in the shape of a bottom plate 8 with two rigid upright gables 9 and 10.

Fastened between the gables 9 and 10 are two parallel bars 11 and 12, on which a carriage 13 is displaceable to and fro. The carriage 13 supports a holder 14 for the object to be ground, which may be of any kind where an edge grinding is desired, and preferably a grinding with great grinding accuracy of a non-even profile, e.g. a skate 15 as is shown in the FIGS. 2 and 3. The holder 14 in the shown case is formed with a slot 16, into which the rail for the skate can be inserted and locked by means of an expansion disc 17.

The grinding wheel 18, which as an alternative may be a grinding belt or some other corresponding grinding member, is mounted on a swingable bar 19, which is swingable about a bolt 20 on the one gable 10 and which with its opposite end is connected to the member 5 for the raising and lowering of the grinding wheel. To have the smallest possible swinging mass in the swingable bar 19 the driving motor 21 for the grinding wheel 18 is mounted as near as possible to the pivot bolt 20 and it is driven via a toothed belt 22, a V-belt or the like.

Provided for driving the carriage 13 with its holder 14 for the object to be ground is a motor 23 which is mounted onto the one gable 10 of the basic frame and which, preferably via a reduction gear, drives an endless toothed belt 24, to the one loop of which the carriage 13 with the holder 14 for the object to be ground is connected by means of an attachment member.

Provided for the vertical moving of the grinding wheel is likewise a motor 25, which via a reduction gear drives an endless toothed belt 26, to the one loop of which the vertically movable end of the swingable bar 19 is connected.

The two driving motors 23 and 25 are of a reversible pulse motor type, which by means of control signals can be driven over a longer or shorter distance, e.g. a very little portion of one rotation. By further having the motors 23 and 25 connected to their toothed belts 24 and 26 via reduction gears, one pulse in the pulse motor will advance the carriage 13 or the swingable bar 19 with the grinding wheel 18 for an extremely short distance.

Mounted in the carriage 13 is a highly sensitive scanner 27, the purpose of which is to observe the slightest variation of velocity of the carriage 13 with the skate holder 14 and the skate 15, which variation appears when the scanning member of the grinding apparatus during its Y-movement contacts the rail of the skate. The scanner 27 is connected to a computer unit 7 of a kind known per se. Also connected to the computer 7 are (not shown) control members for the horizontal motor 23, denominated the X-motor, and the vertical motor 25, denominated the Y-motor, so that the computer through signals exactly can initiate and regulate the motion design for the motors.

It is important that not any grinding dust from the, grinding wheel 18 penetrates to the sensitive controlling and driving machine parts, and for this reason the grinding wheel is equipped with radial blades 28, and the mentioned parts are protected by an evacuating device as shown in FIG. 4. This device consists of a protecting rear shield 29 with a slot 30 for passage of the shaft of the grinding wheel 18. Furthermore, the shield has transverse part-circular guide bars 31, which together with a (non-shown) exterior shield form a partially closed grinding wheel chamber 32 with a deflector 33 for grinding dust which is blown down into a receptacle 34 directed by a guide rail 35.

Disposed on the rear shield 29 is also a member for adjustment of the grinding wheel and consisting of an adjuster holder 37 which is displaceable along a bar 36 and which at its end nearest to the grinding wheel is equipped with a set screw 30 having a diamond applied at its nose. The adjuster holder 37 is with its hub turnable about the bar 36 and is capable, while simultaneous screwing in of the screw 38, of accomplishing an adjustment of the grinding wheel. By normal adjustment the grinding wheel obtains an externally arcuate grinding surface which is suited for so-called hollow grinding of skates and other objects. For rendering possible a lateral displacement of the top of the grinding surface in the one or other direction, the end 39 of the bar 36 is laterally shiftable which may be suitable or necessary when grinding specific transversal profiles of the object to be ground. By simultaneously effected lateral displacement of the bar end 39 and turning and blocking of the adjuster holder it is possible also to adjust the grinding wheel to present an entirely plane grinding surface.

The computer 7 is of a kind known per se and is programmed to perform two functions following in serial sequence, viz. firstly a recording of the scanned horizontal and vertical displacement of a scanner for the existing grinding profile, thereupon a control of the grinding wheel motors 23 and 25 as a result of computation of the recorded values together with information about the desired profile, so that a control information for an exact desired grinding profile is obtained.

The computer program is of a relatively complicated nature and does not form part of the invention proper. As will become evident from the subsequent description of the functions, it is essential that the scanning of the grinding profile is performed separately and alternating, so as thereby to render possible to avoid disturbing vibrations emanating from the horizontal motor and the parts connected thereto during the scanning in the vertical direction.

Suitably, the control program of the computer is modelled in such a manner that the grinding work is commenced at the one end and performed alternately from the one to the other side of the skate. It is, however, possible to execute the grinding movements in any arbitrary other manner. There is also a possibility to introduce, if desired, such corrections into the computer which become actual in consequence of some wear of the grinding wheel during the first part of the grinding procedure.

The described device functions in the following manner:

1. Scanning member of the grinding profile: Disposed on the swingable bar 19 is a scanner which may be a pin or some other member, but which in the presented case for the sake of simplicity is constituted by the grinding wheel 18 proper. The purpose of the scanning operation is to obtain a series of information about the existing profile of an object which shall be ground. The computer contains already data about the desired profile to be obtained by the grinding, and these data are utilized for computation of that grinding operation which shall be performed on the actual object to be ground. Of course, it is possible also to obtain the desired grinding profile also by inserting into the holder 14 a gauge with the exact desired profile, and with the scanning member scanning the profile of the gauge and the scanner 27 storing corresponding values in the computer.

The object, e.g. a skate 15, is introduced with its rail into the slot 16 in the holder 14 and is chucked by means of the expansion disc 17. The starting place for the scanning may be anywhere along the rail of the skate, but most suitably the scanning operation is started at the longitudinal center of the skate and carried out by alternating action of the X-motor 23 and the Y-motor 25, which motors are of the pulse type and have such a reduction gear that one can obtain a stepping between the scanning points which is variable within wide limits. In some cases, great exactitude is demanded, and then the action spots are located closely—in other cases less accuracy is required, and then the action spots are placed less closely. The pulse length is determined in the computer program and is put in automatically during the scanning operation depending on the geometry of the profile. Each scanning cycle involves as a first moment an activity of the X-motor 23 so that the carriage 13 with the skate 15 is moved for the predetermined step, and as the second moment an activity of the Y-motor 25 which drives the swingable bar 19 with the idle grinding wheel 18 upwards until the scanner 27 observes a speed variation by the grinding wheel abutting against the rail of the skate and transmits a moment to the scanner. The computer records and coordinates the horizontal position of the carriage 13 and the vertical position of the grinding wheel 18. Hereupon a series of similar cycles follows until the grinding wheel (scanning member) has reached the opposite end of the rail of the skate, whereby the scanning and recording of the desired grind profile are finished. The values are stored in the computer and will be utilized in the following grinding operation. By the scanning any arbitrarily shaped profile can be read and recorded, which is valuable in the grinding of many objects, such as skates, for example, which often have extremely varying and individual profiles to be ground with a mixture of convex and plane rail portions.

II. Grinding operation. The grinding is effected by starting the grinding wheel motor 21 which is caused to be operative until the grinding operation is finished. The grinding begins at a suitable point of the object to be ground, e.g. at or near its one end, and is continued in exact conformity with the values calculated for the Y-motor 25 and by simultaneous agitation of the X-motor 23 for the carriage 13 and the Y-motor 25 for the swingable bar 19 with the grinding wheel 18. The grinding is performed from the one end to the other of the rail of the skate and alternately in both directions.

During the entire grinding operation the radial blades 28 on the grinding wheel attend to cause grinding dust to be blown away from the grinding zone and conducted down into the collecting receptacle 34.

After the grinding operation it may be appropriate to adjust the grinding wheel, and this is done by removing the ground object, e.g. the skate, from the holder 14 and moving the adjuster holder 37 into its end position where the adjuster screw 38 is located straightly over the axle of the grinding wheel 18. Depending on the profile which is desired for the grinding wheel, the end 39 of the bar 36 is brought into desired position, and while the grinding wheel is rotating the adjuster screw is screwed down until its nose comes into contact with the grinding wheel, and the adjusting operation follows by simultaneous careful screwing down of the adjuster holder 37 and turning said adjuster holder 37 about the bar 36. As mentioned earlier, a plurality of grind profiles can be accomplished, both convex and plane ones, as is indicated in FIG. 5.

We claim:

1. A method for grinding elongated objects, especially for edge grinding of objects, comprising the steps of:

locating an object to be ground and having two ends in a horizontally displaceable carriage, scanning an existing grind profile by displacing the carriage in steps of predetermined length and conveying a horizontally fixed scanning member vertically over at least one scanning cycle to the object to be ground, recording and coordinating for every scanning cycle a position of the carriage and the corresponding position of the scanning member, performing horizontal displacement of the carriage and vertical displacement of the scanning member separately and in subsequent working steps, grinding the object in at least one working step in correspondence to the scanning cycles.

2. The method according to claim 1, further comprising calculating a length for each horizontal displacement step so that the length of the step is reduced at curves in the object to be ground.

3. The method according to claim 1, including observing a vertical position of the scanning member in relation to the object to be ground via a change in velocity of a scanner connected to the carriage each time said scanning member abuts the object to be ground, scanning the vertical position in two or more subsequent short movements and recording the position when two or more exactly equal values have been obtained.

4. The method according to claim 1, further comprising scanning in two working steps starting at least near a longitudinal center point of the object to be ground, firstly at one end of the object and thereafter at the other end thereof.

5. The method according to claim 1, further comprising grinding the object in correspondence to the desired values calculated by the computer by alternately grinding from one and the other end of the object.

6. The method according to claim 1 further comprising determining desired values for the grinding by scanning of the object to be ground and correcting against stored values in a computer.

7. Device for grinding elongated objects comprising a basic frame supporting in a horizontally movable manner a carriage with members for clamping a longitudinally extending object to be ground, the vertically displaceable, horizontally fixed scanning member mounted in the frame for determining an existent grind profile, a grinding member for accomplishing a profile computed and recorded in a computer, the carriage and the scanning member being operated by separate displacing motors performing separate movements in the alternating working steps.

8. The device according to claim 7, wherein the carriage with the clamping members for the object to be ground is displaceable on a pair of parallel bars under the action of a first driving motor and the scanning member is actuated by a second driving motor, the driving motors being operated independently of one another during a first working moment and simultaneously during a second working moment controlled by a computer.

9. Device according to claim 7, wherein the scanning member further comprises a grinding wheel, and the carriage with the members for clamping the object to be ground is directly connected to a member for exact observation of vertical position when the grinding wheel, during the scanning in each working moment, comes into contact with the object to be ground.

10. Device according to claim 8, wherein the scanning member is a grinding wheel mounted on a bar swingable about a point near an end of the frame, the grinding wheel being raised and lowered by means of a motor to approach and retract from, respectively, the object to be ground the driving member for the grinding wheel being mounted near the pivot point of the swingable bar.

11. Device according to claim 7, wherein the carriage and the scanning member are displaceable each by an appertaining pulse motor with very small pulse intervals the pulse interval being multiplied in arbitrary manifold by means of a controlling computer.

12. Device according to claim 7, wherein the grinding member further comprises the grinding wheel equipped with radial blades and substantially encased in a grinding wheel chamber, from which grinding dust can be removed by the action of air form the radial blades.

13. The method according to claim 6 further comprising determining the desired valves for grinding by scanning a gauge having the desired grind profile.

* * * * *